United States Patent [19]

Finkl et al.

[11] Patent Number: 4,780,134

[45] Date of Patent: Oct. 25, 1988

[54] SIMPLIFIED METHOD AND APPARATUS FOR TREATING MOLTEN STEEL

[75] Inventors: Charles W. Finkl, Chicago; Bruce Liimatainen, Riverside, both of Ill.

[73] Assignee: A. Finkl & Sons Co., Chicago, Ill.

[21] Appl. No.: 910,704

[22] Filed: Sep. 23, 1986

[51] Int. Cl.[4] ..... C21C 5/52; C21C 7/10

[52] U.S. Cl. ..... 75/10.39; 75/49

[58] Field of Search ..... 75/49, 10.39, 10.64

[56] References Cited

U.S. PATENT DOCUMENTS 4,200,452 4/1980 Savov ..... 75/49

*Primary Examiner*—Peter D. Rosenberg

*Attorney, Agent, or Firm*—James G. Staples

[57] ABSTRACT

A method and apparatus for post-melting treatment of molten steel in which a container of molten steel is subjected to a sub-atmospheric pressure generated by air ejector means and, simultaneously, to an inert gas purge. A higher inert gas purge rate is used with an air ejector system than with a steam jet ejector system because the treatment pressure in the air ejector system is higher than the treatment pressure in the steam jet system. Heating means for at least partially compensating for heat loss is also disclosed.

11 Claims, 3 Drawing Sheets

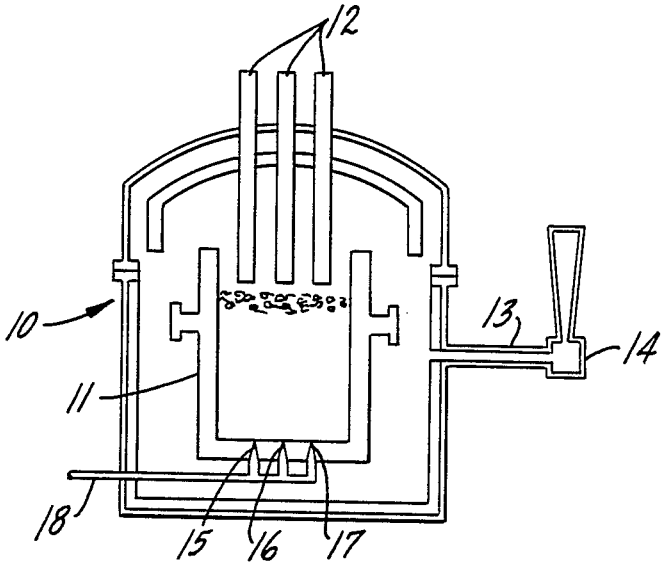
Fig. 1.
Fig. 2.
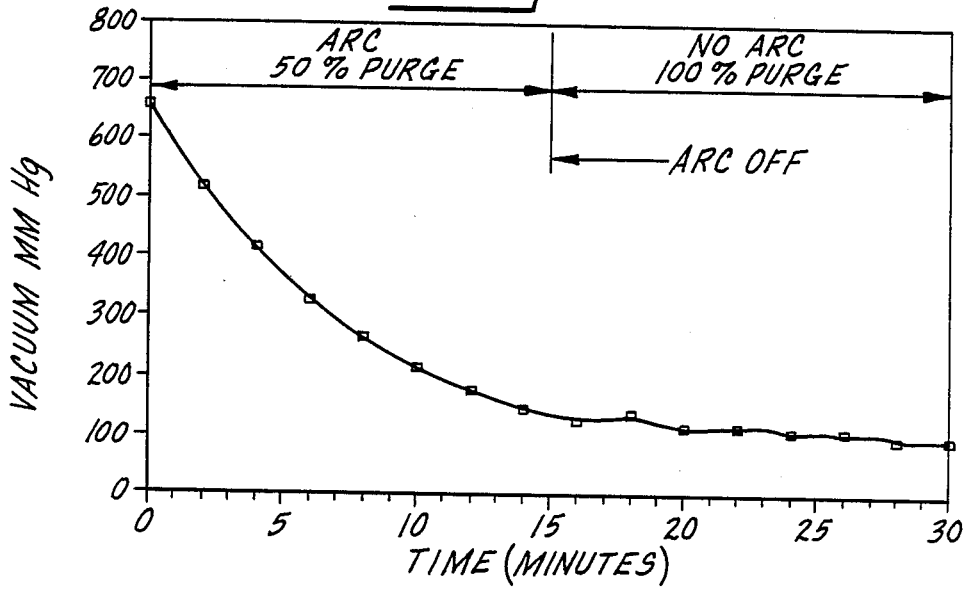
Fig. 7.
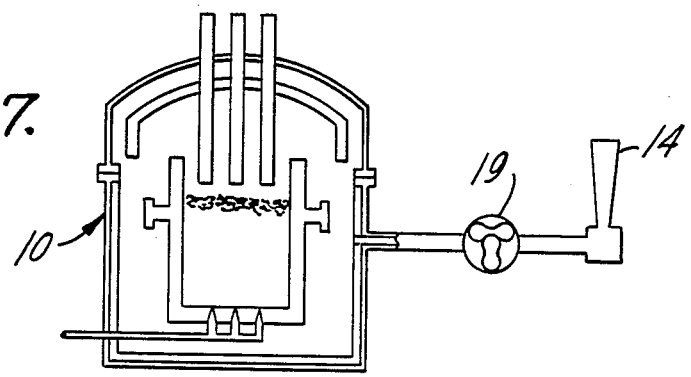

Fig. 5.
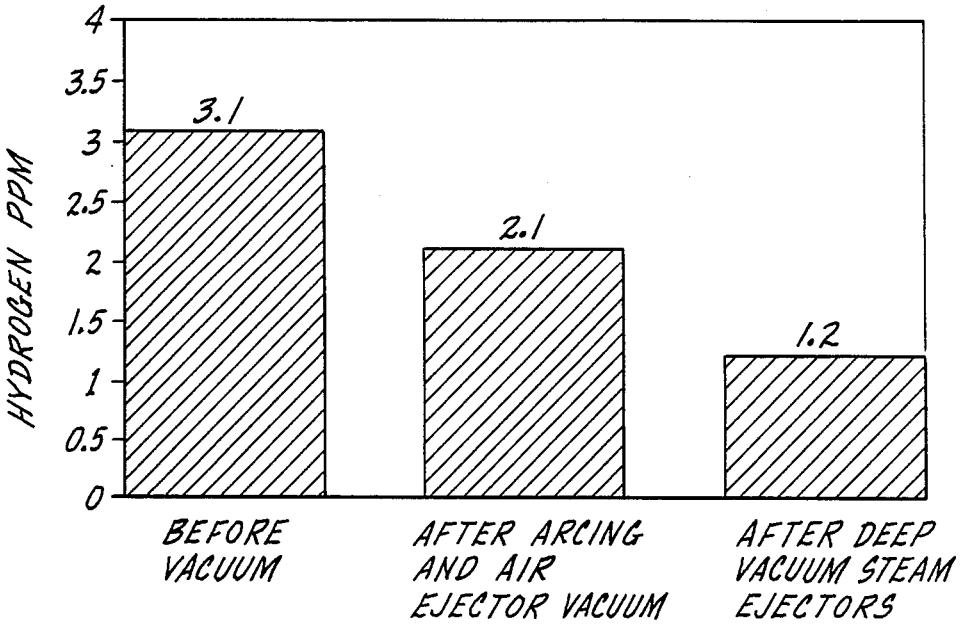
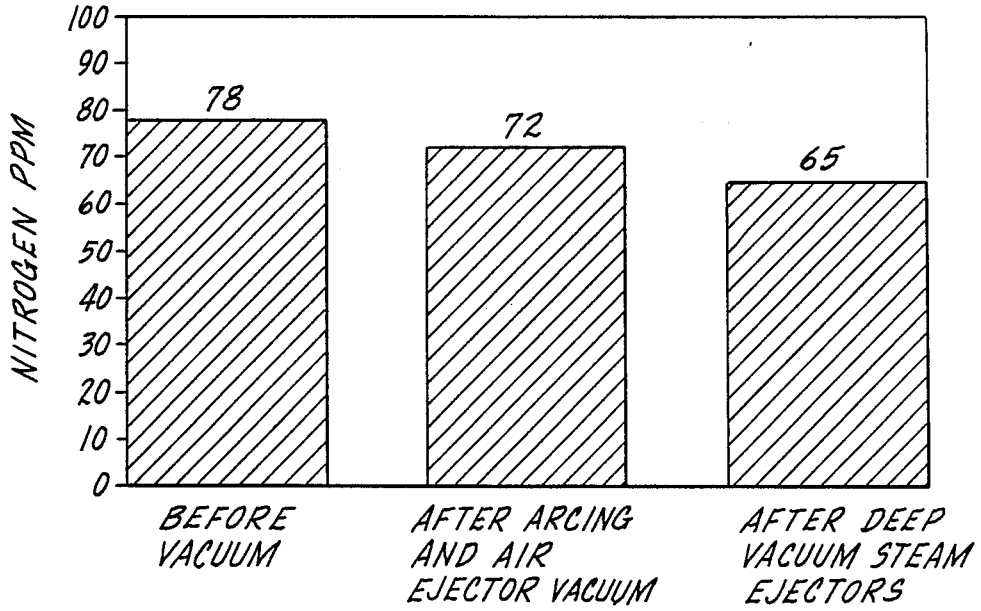
Fig. 6.

SIMPLIFIED METHOD AND APPARATUS FOR TREATING MOLTEN STEEL

This invention relates to a method and apparatus for treating molten metal to lower the oxygen, hydrogen, and, to some extent, the nitrogen content thereof in a manner which is less capital intensive, easier to operate and simpler in construction and operation than the vacuum arc degassing system.

BACKGROUND OF THE INVENTION

The conventional vacuum arc degassing system enables a user to lower oxygen and hydrogen contents of molten steel to low levels by the use of a sub-atmospheric pressure (or vacuum) which may be as low as less than 1 mm Hg if flake free hydrogen levels in large sections are desired, an alternating current electric arc which is struck directly between the AC electrodes and the molten steel, and inert gas purging. A typical example can be seen from U.S. Pat. No. 3,501,289 with respect to which the present invention is a further development. Almost invariably, the vacuum in this system, known as the vacuum arc degassing system, is generated by a plurality of steam jet ejectors and it requires, in the United States at least, licensed boiler tenders to operate. Also, in the vast majority of commercial installations, the inert gas purging is derived from, preferably, one or, at most, two porous bricks, each of which admits from 3–5 cu. ft./min. of purging gas to the molten steel. In some instances a tuyere which produces the same stirring characteristics, or even a porous bottom, may be substituted for the purging brick.

Such a system is relatively expensive to build since the steam jet ejector system is relatively expensive. Further, such a system is relatively costly to operate due to operators licensing requirements. It has however gained wide acceptance due to the ability to achieve the desired low gas results, as well as many other now well recognized advantages over prior systems including temperature and chemical homogenization, concast applications and others.

It is highly desirable however that the art have access to a system which achieves all, or substantially all, of the advantages of the vacuum arc degassing system but at a lower equipment and operating cost and is simpler to operate.

DESCRIPTION OF THE INVENTION

The invention is illustrated more or less diagrammatically in the following drawing wherein:

FIG. 1 is a schematic view of the system;

FIG. 2 is a graph plotting vacuum level against time in a heat run in a physical embodiment of FIG. 1;

FIG. 5 is a bar graph showing hydrogen removal;

FIG. 6 is a bar graph showing nitrogen removal; and

FIG. 7 is a diagrammatic sketch of another embodiment of the invention.

Like reference numerals will refer to like parts from Figure to Figure in the drawing.

Figure 3:
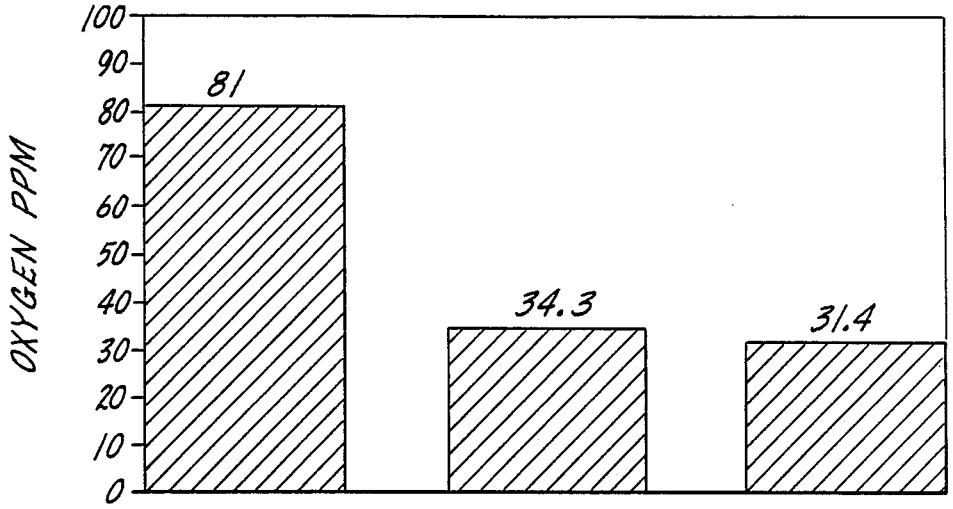
FIG. 3 is a bar graph showing oxygen removal.

The invention requires a sealed chamber and sealed electrodes as in a conventional vacuum arc degassing system. However, instead of using a large steam ejector system with barometric condensers, cooling tower, circulating pumps, and hot well, the chamber exhaust connection goes to, for example, one or more small compressed air ejectors and the purging capacity is substantially increased. FIG. 1 shows a schematic of the system.

The system includes a sealed tank, indicated generally at 10, which receives a ladle 11 of molten steel to be treated whereby the space above the metal is sealed at all times from outside ambient atmosphere. It will be understood that this basic structure may take the form of a container for the molten steel which receives a hood; the hood and container together defining the isolated environment above the molten steel. In this instance three alternating current non-consumable electrodes, such as conventional graphite electrodes, are shown at 12 since the heats described herein were performed on vacuum arc degassing system equipment. It should be understood that if side wall wear of the container, usually a ladle, is a concern, a single electrode may be used. The single electrode current may be single phase AC, three phase wye connected AC which results in a rippled current, or DC. The tank exhausts through a pipe 13 which opens into an air ejector 14 which may have the capacity, for example, when treating an approximately 60 metric ton heat of low alloy steel in a chamber of about 1800 cu. ft. capacity of lowering the pressure in the chamber to the beginning of the glow range of the system, such as, purely by way of example, about 100 mg Hg.

It will be understood that a definite vacuum level for the onset of glow cannot be given because glow depends on factors which vary from installation to installation such as vacuum level, voltage, amperage, gas composition in the sealed chamber, electrode temperature, dust in the environment above the molten steel, and others. In the illustrated example, 14" graphite electrodes operating at about 230 volts and 18,000 amps were employed and glow was observed to begin generally in the 150 mm Hg to 80 mm Hg range.

Three porous purging bricks are indicated at 15, 16, 17 and a source of purging gas, such as argon, is indicated at 18. By suitable valving, the rate of purging gas per plug can be varied from 0 to about $8\frac{1}{2}$ cu. ft./min.

In several trial heats three purge plugs were used in the ladle instead of the normal two plugs which resulted in high purge rates up to a combined total of 25 SCFM. This is approximately five times the normal purge rate used today.

The process takes full advantage of the "dynamic window" under the arcs to enhance gas removal, said window being formed by the power of the arcs which exposes bare metal to the arcs and facilitates the disassociation of alumina into aluminum and oxygen, the oxygen in turn combining with carbon to form CO in accordance with the following equation:

$$Al_2O_3(s)+3C=2\,Al+3CO(g).$$

Oxygen is removed from the bath as a reaction product of the oxygen in the bath and the carbon in the steel or the electrodes. The heat of disassociation of alumina may be noted from "Thermochemistry of Steelmaking," Elliot and Gleiser, Vol. I, pages 161, 162 and 277, 1960, Addison-Wesley Pub. Co., Reading, Mass.

It will be noted that with high purging rates as described herein plus air ejector means placed in series, a low absolute pressure can be attained and hence a high degree of hydrogen removal is made possible, all without the equipment and operating expense of steam jet ejectors.

A small diaphragm vacuum pump was connected to the vacuum tank close to the ladle brim to measure an off-gas sample, the pump discharge generating positive pressure and flow to a Horiba Model PIR-2000 CO Analyzer.

The process consists essentially of the combined use of a heating arc, with an air ejector and a higher purge rate than in a conventional vacuum arc degassing cycle. Medium vacuum levels are attained. A typical cycle is illustrated in FIG. 2.

The heat trial size was normally 60 metric tons. The first 15 minutes were arced using a 50% purge rate which resulted in the admission of a total of 12 SCFM. This arcing period was utilized to enhance oxygen removal and temperature control. The second 15 minute portion (no arcing) of the cycle was run at 100% purge rate, 25 SCFM, with the air ejector system pulling down to a deeper vacuum level (around 100 mm) to facilitate hydrogen removal. It will be understood that a larger gas input may be required for a larger container and, correspondingly, a smaller input for a smaller container to achieve the desired results.

For best results the steel should be tapped from the electric furnace at the lowest practicable hydrogen level. One way to achieve this result is to generate a vigorous CO boil in the electric furnace shortly prior to tap. In addition, care should be taken to ensure that there is minimum moisture in furnace alloy additions and slag reagents.

An average hydrogen level of the molten steel going into the vacuum tank of about 3.2 ppm maximum is attainable and desirable.

A fluid slag is necessary to allow maximum gas removal, especially if low-sulfur chemistry is desired. A di-calcium silicate slag ($Ca_2SiO_4$) with about a $2\frac{1}{4}$ to 1 lime-silica ratio which has a low melting point—1500° C. (or 2732° F.) may be used to great advantage.

Six trial heats were evaluated representing various compositions. Standard grades AISI 1035 and 4340 were treated as well as a speciality die steel and P-20, all as illustrated in Table I.

TABLE I

| | C | Mn | P | S | Si | Ni | Cr | Mo | V | Al |
|---|---|---|---|---|---|---|---|---|---|---|
| FX | .50/.58 | .75/.95 | .010 | .030 | .15/.35 | .85/1.05 | .85/1.15 | .33/.43 | .05 | .015/.025 |
| P20 | .30/.35 | .70/.90 | .010 | .020 | .35/.55 | — | 1.55/1.85 | .40/.50 | — | .015/.025 |

The results obtained utilizing the air ejector system are illustrated in Table II. In this instance, all heats were subsequently subjected to the normal deep vacuum cycle of less than 1 mm since the product specifications required flake free steel and thus this extra precaution was deemed prudent in view of the lack of extended experience. Gas analyses after the deep vacuum cycle are included.

TABLE II

| | | | | | | Air Ejector Heats | | | | | | | | |
|---|---|---|---|---|---|---|---|---|---|---|---|---|---|---|
| Heat# | Grade | H | N | O | | Purge Plugs | Arc Time | Medium Vac Time | Total Time Air Ejector | Best Vac MM | Temp Start | Temp Finish | Total Ft.$^3$ Ar | Highest Purge Rate Ft.$^3$/Min. |
| 264468 | FX | 2.5 | 82 | 64 | BV | 3 | 8.5 | 21.5 | 30 | 193 | 3040 | 2870 | 750 | 25 |
| | | 2.0 | 72 | 27 | AA | | | | | | | | | |
| | | 1.2 | 63 | 20 | AV | | | | | | | | | |
| 165135 | 1035 | 2.6 | 59 | 63 | BV | 3 | 15 | 15 | 30 | 147 | 2990 | 2920 | 688 | 23 |
| | | 1.9 | 74 | 39 | AA | | | | | | | | | |
| | | 0.9 | 64 | 36 | AV | | | | | | | | | |
| 264685 | 4340 | 3.2 | 66 | 105 | BV | 2 | 17.5 | 12.5 | 30 | 92 | 2975 | 2840 | 284 | 10 |
| | | 2.0 | 64 | 30 | AA | | | | | | | | | |
| | | 1.4 | 61 | 44 | AV | | | | | | | | | |
| 165128 | MD | 3.1 | 101 | 76 | BV | 2 | 11.5 | 20 | 31.5 | 103 | 3035 | 2910 | 443 | 14 |
| | | 2.2 | 89 | 36 | AA | | | | | | | | | |
| | | 1.9 | 81 | 24 | AV | | | | | | | | | |
| 264695 | FX | 4.2 | 81 | 89 | BV | 2 | 15 | 15 | 30 | 100 | 2960 | 2885 | 338 | 11 |
| | | 2.7 | 70 | 35 | AA | | | | | | | | | |
| | | 0.8 | 64 | | AV | | | | | | | | | |
| 165139 | FX. | 3.2 | 79 | 89 | BV | 3 | 15 | 15 | 30 | 86 | 2990 | 2930 | 200 | 7 |
| | | 2.1 | 63 | 39 | AA | | | | | | | | | |
| | | 1.2 | 55 | 33 | AV | | | | | | | | | |

BV = Before Arcing & Air Ejector
AA = After Arcing & Air Ejector @ 100 mm Hg Abs.
AV = After Deep Vacuum Treatment @ <1 mm Hg Abs.

Sample pins of the molten steel were used for gas anlaysis. The pins were taken with an evacuated glass tube drawn from a spoon sample which are immediately quenched in ice water. Oxygen and nitrogen were determined on a LECO TC30 special instrument and hydrogen was determined on an Itac 01 instrument.

The oxygen removal in the air ejector cycle varied from a high of 71% to a low of 39% with 56% average. The average oxygen levels for the air ejector and for comparison, a vacuum arc degassing cycle are shown in FIG. 3.

The results show removal of an average of 47 ppm of oxygen using the air ejectors. An additional 3 ppm of oxygen was removed through the deep vacuum cycle. The greatest oxygen removal with the air ejectors was 75 ppm with the least being 24.5 ppm.

Figure 4:
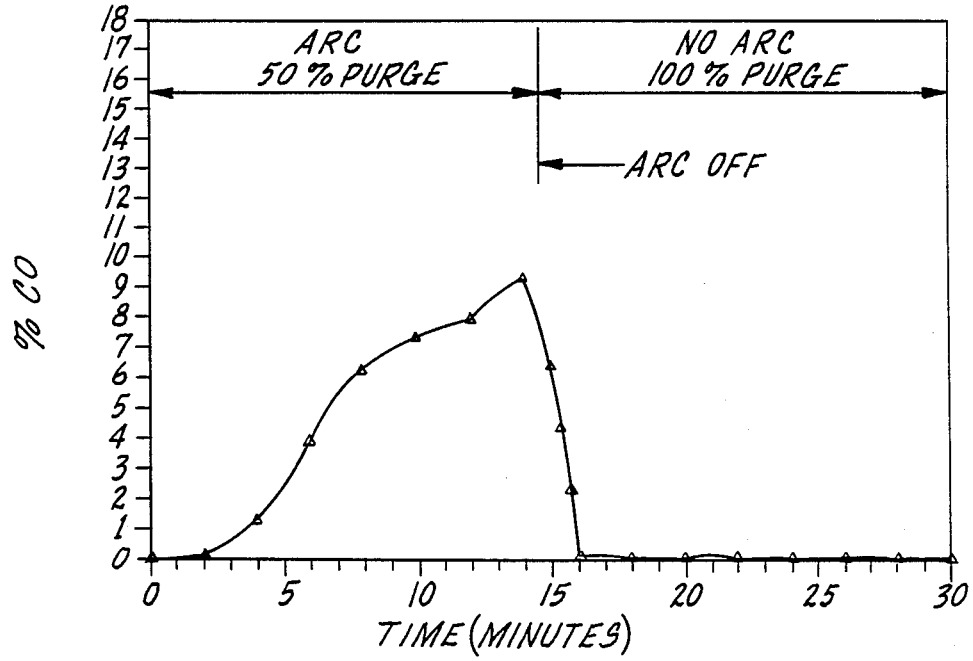
FIG. 4 is a graph plotting CO evolution against time.

The large amount of oxygen removal during the air ejector cycle can be attributed to the combination of the arcs with high purge rate in the beginning of the cycle. Referring to FIG. 4, it will be noted that the CO present in the vacuum chamber goes to a high of 10% while arcing and then decreases rapidly when the arc is extinguished. If flake free product is not required (i.e.: 2.2 ppm $H_2$ max.), and thus only oxygen was of concern, a shortened cycle of 15 minutes using a high purge rate and heating will accomplish the objective.

The air ejector cycle hydrogen removal varied from a high of 36% to a low of 20% with a 31% average. The average hydrogen levels are shown in FIG. 5.

An average of 1 ppm of hydrogen was removed using the air ejectors. If the steel, at the time of tapping from the melting unit, has a sufficiently low hydrogen content, say 3.2 ppm or less, it is possible to reach flake-free hydrogen levels after the air ejector process alone. An additional 0.9 ppm hydrogen was removed through a multi-stage steam ejector deep vacuum cycle. The greatest hydrogen removal using air ejectors was 1.5 ppm—with the least being 0.5 ppm.

The air ejector cycle nitrogen removal varied from a high of 20% to a low of 3% with an average removal value of 12%. The average nitrogen levels are shown in FIG. 6.

FIG. 7 illustrates an alternative embodiment in which an air ejector 14, as above described, or a mechanical pump with a compression ratio of about 5 to 1 is placed in the exhaust line down stream from a blower 19 of the Roots, vane, piston or screw type, or a water ring pump having a compression ratio of about 2 to 1. As a result an absolute vacuum in the chamber 10 of about 75 mm Hg can be obtained. Proper filtration upstream of the pump is of course essential to preserve the life of the pump.

It will be noted that with high purging rates as described herein plus air ejector means placed in series, a low absolute pressure can be attained and hence a great degree of hydrogen removal is made possible, all without the equipment and operating expense of steam jet ejectors.

Air ejectors are small and inexpensive and an excellent standby in case of steam failure. Two, 2" air ejectors and one, 3" air ejector were used for the trial heats described above.

| No. of Air Ejectors | Suction Inlet | Motive Inlet | Motive Fluid (Compressed Air) |
|---|---|---|---|
| 1 | 3" | 2" | 2050#/Hr. |
| 2 | 2" | 1¼" | 1025#/Hr. each |

The 2" air ejectors operated in parallel much like hoggers to pull down to 200 mm. At this vacuum level the air supply was cut over to the 3" ejector to continue down to deeper vacuum of around 100 mm. Using this operational sequence, the motive fluid requirement was essentially constant at 2050#/Hr. (482 CFM) of 100 psig compressed air. The air was supplied by a 100 HP rotary screw compressor.

Air ejectors combined with arc and high purge rates are a means of processing heats as a stand-alone backup system in the event of a steam supply failure in a conventional steam ejector system. The air ejectors used for these trials can be backup for a conventional vacuum arc degassing system.

The maximum perge rate can be described as the maximum rate the available free board in the container can accommodate without boilover, and it will vary from installation to installation. In effect, it is believed that the equipment generated partial vacuum plus the high purge rate produces a hydrogen partial pressue which equals 1 mm Hg absolute.

The invention can be used as the sole means for achieving the disclosed advantages in Third World countries where a shortage of technical, maintenance, and operations staff exists. Short cycles will be possible if heating, deoxidation, and alloy additions are done simultaneously, thereby eliminating the need to go to 1 mm Hg absolute pressure. By using compressed air as the motive fluid, the complexity of the vacuum system is reduced dramatically. A number of items essential to a steam ejector system can be eliminated including:

(1) Large ejectors, condensors, and piping
(2) Boiler and feed water treatment
(3) Large cooling tower.

Using vacuum arc degassing costs as a reference, it is estimated that the herein disclosed system with air ejectors would be about 20% cheaper than a conventional vacuum arc degassing with a steam ejector system.

Another advantage is that the VAD tank and arcing systems remain unchanged in design. If a plant's product mix were to change and deep vacuum was required on all heats, the additional requirements could be easily accommodated. By proper layout of the described system, it will be a simple construction task to add a conventional steam ejector system.

Further, the system is usable in very cold climates, such as Alberta, where water in conventional steam ejector systems must be heated due to sub-freezing temperatures in the winter months.

Although a preferred embodiment of the invention has been illustrated and described, it will be apparent that modification may be made within the spirit and scope of the invention. Accordingly the scope of the invention should be limited solely by the scope of the hereinafter appended claims.

We claim:

1. In a method of treating molten steel the steps of
subjecting molten steel to a sub-atmospheric pressure in a sealed chamber, and
during at least a portion of the time the steel is subjected to the sub-atmospheric pressure,
vigorously purging the molten steel with gas, and
also during at least a portion of the time the steel is subjected to the sub-atmospheric pressure,
maintaining a heating arc between electrode means and the molten steel,
said sub-atmospheric pressure being generated by air ejector means,
said gas being purged at a substantially higher purge rate than would be required in a steam jet ejector system for obtaining a comparable measured sub-atmospheric pressure.

2. The method of claim 1 further characterized in that the sub-atmospheric pressure is no lower than the lowest absolute pressure corresponding to the commencement of glow as determined by the system parameters.

3. The method of claim 2 further characterized in that the purging rate reaches about 25 SCFM during at least a portion of the cycle.

4. The method of claim 1 further characterized in that the maximum purge rate is the maximum rate which the available freeboard in the container can accommodate.

5. The method of claim 1 further characterized in that the process is conducted in the presence of a slag, if slag is present, having a melting point below the temperature of the steel.

6. The method of claim 5 further characterized in that the slag is a di-calcium silicate slag having a lime:-silica ratio of about 2¼1.

7. In a batch type system for treating molten metal, a container for holding molten untreated steel, means forming a sealed atmosphere above the molten steel which isolates the space above the molten steel from the outside, ambient atmosphere, heating arc means arranged to maintain a heating arc between the electrodes and the molten steel in the container, air ejector means for creating a sub-atmospheric pressure within the isolated environment above the molten steel down to the absolute pressure at which glow would begin given the parameters of the system, and purging means arranged to admit a purging gas into heating molten steel in the container in a guantity sufficient to set up a vigorous boil in the container.

8. The batch type system of claim 7 further characterized in that the purging means consists of one or more of purge brick means, tuyere means, or a gas porous bottom of the container.

9. The batch type system of claim 7 further characterized by and including a second sub-atmospheric pressure generating means consisting of steam jet ejector means, said steam jet ejector means being capable of creating a sub-atmospheric pressure in the sealed atmosphere above the molten steel sufficiently low to reduce the hydrogen level in the final product to the flake-free level.

10. The batch type system of claim 7 further characterized by and including mechanical pump means located in series with the air ejector means.

11. The batch type system of claim 7 further characterized in that the heating arc means consists of a means selected from the group of three phase AC, single phase AC or DC equipment.

* * * * *